US011313207B2

(12) United States Patent
Yang et al.

(10) Patent No.: US 11,313,207 B2
(45) Date of Patent: Apr. 26, 2022

(54) DEEP-SEA SUBMARINE GAS HYDRATE COLLECTING METHOD AND PRODUCTION HOUSE

(71) Applicant: China University of Petroleum (East China), Dongying (CN)

(72) Inventors: Jinxiu Yang, Dongying (CN); Mingyue Lu, Dongying (CN); Shuangfang Lu, Dongying (CN); Min Wang, Dongying (CN); Ning Qi, Dongying (CN); Ying Xia, Dongying (CN); Shaogui Deng, Dongying (CN); Yong Chen, Dongying (CN); Zhoutuo Wei, Dongying (CN); Mingming Tang, Dongying (CN)

(73) Assignee: CHINA UNIVERSITY OF PETROLEUM (EAST CHINA), Dongying (CN)

( * ) Notice: Subject to any disclaimer, the term of this patent is extended or adjusted under 35 U.S.C. 154(b) by 0 days.

(21) Appl. No.: 17/180,910

(22) Filed: Feb. 22, 2021

(65) Prior Publication Data

US 2022/0098958 A1 Mar. 31, 2022

(30) Foreign Application Priority Data

Sep. 25, 2020 (CN) ..... 202011022625.X

(51) Int. Cl.
*E21B 41/00* (2006.01)

(52) U.S. Cl.
CPC ..... *E21B 41/0099* (2020.05)

(58) Field of Classification Search
CPC ..... E21B 41/0099; E21B 43/0122
See application file for complete search history.

(56) References Cited

U.S. PATENT DOCUMENTS 3,159,006 A * 12/1964 Sliepcevich ..... F17C 3/005 62/48.1
3,195,310 A * 7/1965 Schroeder ..... F17C 3/005 405/56

(Continued)

FOREIGN PATENT DOCUMENTS

CN 102337895 A 2/2012
CN 108699900 A 10/2018

(Continued)

*Primary Examiner* — Aaron L Lembo

(57) ABSTRACT

A deep-sea submarine gas hydrate collecting method and a production house for the first time, the collecting method comprises the steps of: determining an active methane leakage zone near a landward limit of a submarine gas hydrate stability zone, acquiring submarine methane leakage in-situ observation data, determining a methane leakage rate and evaluating its economy; mounting a production house on the seabed, opening a monitoring system after the mounting, monitoring the submarine methane leakage condition and hydrate generation progress in real time, evaluating a hydrate generation amount, and performing hydrate acquisition work; and rapidly processing the gas hydrate in the house by a gas hydrate collecting system of an offshore platform, and continuously monitoring the methane leakage condition. A large amount of methane leaked can be collected, thereof, the method has dual meanings of resources and environment.

10 Claims, 7 Drawing Sheets

(56) References Cited

U.S. PATENT DOCUMENTS 5,050,680 A * 9/1991 Diehl ..... E21B 43/0122 166/356
6,192,691 B1 * 2/2001 Nohmura ..... E21B 43/0122 62/53.1
6,978,837 B2 * 12/2005 Yemington ..... E21B 43/36 166/303
6,994,159 B2 * 2/2006 Wendland ..... E21B 43/305 166/57
7,546,880 B2 * 6/2009 Zhang ..... E21B 43/0122 166/358
8,496,063 B2 * 7/2013 Paulsen ..... B01D 21/0012 166/357
8,894,325 B2 * 11/2014 Varney ..... B63C 11/52 405/60
9,574,427 B2 * 2/2017 Dirksen ..... E21B 47/00
9,777,547 B1 * 10/2017 Milanovich ..... E21B 43/124
10,267,129 B1 * 4/2019 Sun ..... E21B 43/385
10,344,576 B1 * 7/2019 Hou ..... E21B 43/24
10,815,778 B1 * 10/2020 Hou ..... E21B 49/003
10,816,531 B1 * 10/2020 Hou ..... E21B 49/0875
10,871,055 B2 * 12/2020 Paturu ..... E21B 43/36
10,954,758 B1 * 3/2021 Yan ..... E21B 43/305
10,989,036 B2 * 4/2021 Yan ..... E21B 41/0099
11,002,126 B2 * 5/2021 Wang ..... E21B 21/08
2012/0027519 A1 * 2/2012 Krecke ..... E21B 41/0007 405/65
2012/0213588 A1 * 8/2012 Shifferaw ..... B63B 35/32 405/60
2012/0325489 A1 * 12/2012 Beynet ..... E21B 43/0122 166/353
2013/0270194 A1 * 10/2013 Allen ..... E02F 7/065 210/747.4
2014/0120025 A1 5/2014 McAlister
2015/0090124 A1 * 4/2015 Alqahtani ..... B01D 17/0214 95/253
2015/0260018 A1 * 9/2015 Vu ..... E02B 15/0814 405/60
2016/0069162 A1 * 3/2016 Lynch ..... E21B 41/00 405/52
2021/0206659 A1 * 7/2021 Aoyama ..... E21B 43/01
2021/0254438 A1 * 8/2021 Sun ..... E21B 36/006

FOREIGN PATENT DOCUMENTS

CN 109057758 A 12/2018
CN 210538284 U 5/2020
CN 111236896 A 6/2020
RU 2615192 C 4/2017
WO WO2003102347 A 12/2003

* cited by examiner

DEEP-SEA SUBMARINE GAS HYDRATE COLLECTING METHOD AND PRODUCTION HOUSE

CROSS-REFERENCE TO RELATED APPLICATIONS

The application claims priority to Chinese patent application No. 202011022625X, filed on Sep. 25, 2020, the entire contents of which are incorporated herein by reference.

TECHNICAL FIELD

The disclosure belongs to the technical field of gas hydrate collection, and particularly relates to a deep-sea submarine gas hydrate collecting method and a production house.

BACKGROUND

At present, a large amount of methane is stored in the marine gas hydrate, and the estimated geological reserves thereof exceed the sum of geological reserves of the oil and gas in the known global land. Therefore, the marine gas hydrate is considered to be a clean alternative energy source in the future. In addition to providing a large amount of clean energy, the gas hydrate is considered to play an important role in marine ecological threats (such as ocean acidification) and global warming due to its shallow buried depth, poor stability and greenhouse effect of methane which is much stronger than carbon dioxide. In recent years, "greenhouse effect" and "global warming" have become a hot topic in the world, and many scholars think that methane leakage caused by the decomposition of gas hydrate in polar frozen soil and shallow strata of the deep sea area may be important factors affecting climate change.

In the marine environment, the gas hydrate stability zone is a wedge thickened toward the sea, and the seismic data show that BSR (the seismic mark of the gas hydrate stability bottom boundary) becomes shallower with the depth of the sea bottom becoming shallower, and intersects with the seabed at a certain depth (FIGS. 5 and 6). The intersection of the BSR and the seabed is called LLGHSZ (Landward Limit of Gas Hydrate Stability Zone). The position of LLGHSZ is most sensitive to the change events on the seabed, and it is easily affected by ocean current, sedimentation and diapirism on the seabed to cause vertical shift of the gas hydrate stability zone, thus leading to the generation or decomposition of gas hydrate. As the hydrate decomposes, methane gas released at LLGHSZ may enter the water body, as well as nearby ecosystems such as cold springs, coral reefs, and even the atmosphere, resulting in carbon cycling occurring between the lithosphere, the hydrosphere, the biosphere, and the atmosphere. If the discharged methane enters the water body or even the atmosphere, the environment and the climate can be seriously affected. In the global sea area, there are a lot of methane leakage characteristics near the LLGHSZ at the passive continental margin, such as 570 gas plumes found which had not been found before in the 50-1700 mbsl water depth of the Atlantic continental margin, about 440 of which are located near the present LLGHSZ, which may be related to the vertical dynamic migration of the gas hydrate stability zone when the seabed water temperature changes. Berndt etc. (2014) believed that Arctic warming results in hydrate decomposition, causing substantial methane leakage near the LLGHSZ, and thereby accelerating the global warming. Westbrook etc. (2009) also calculated the rising velocity of the gas plumes in the western Spitsbergen marginal zone (near the Arctic). It is roughly estimated that the methane released by the decomposition of gas hydrate near the LLGHSZ can reach 20 Tg/year, which is a large proportion of the total global carbon cycle per year. In summary, current studies have recognized that there are a large amount of submarine methane leakage characteristics near the LLGHSZ in the deep-sea region of the continental margin of the global sea area, but what human beings can do for the large amount of methane leakage in this particular location has not yet been involved in current studies. In addition, according to the gas hydrate phase diagram, the intersection position of the gas hydrate stability curve and the ground temperature gradient curve represents the bottom boundary of the gas hydrate stability zone, namely the position of the BSR; and the intersection position of the gas hydrate stability curve and the seawater temperature change curve represents the top boundary of the gas hydrate stability zone (FIG. 7). However, because the hydrates resemble an ice cubes and are less dense than sea water, they float upward in the water body. Thus, the region between the seabed and the BSR is generally considered a gas hydrate stability zone. But in theory, the water body near the LLGHSZ (especially a side towards the sea) also belongs to the gas hydrate stability zone. During deep-sea hydrate exploration, researchers buckled a test tube over an upper part of the methane leakage point, and gas hydrate crystals rapidly formed on the wall of the test tube. Inspired by the phenomenon, the disclosure provides a deep-sea submarine gas hydrate collecting method, namely establishing a deep-sea gas hydrate production house According to the analysis, the problems and defects of the existing hydrate exploitation technology are as follows. The traditional drilling method needs to be operated in a deep-sea area, the cost is high, the hydrate decomposition degree is required to be strictly controlled, avoiding risks of submarine sediment instability caused by massive hydrate decomposition which might induce disasters such as submarine slides and damages to submarine engineering facilities. Meanwhile, fracturing fluids often contain a large amount of chemicals that may adversely affect the stratum or even seawater. In addition, the methane leaked from the seabed cannot be effectively collected by a drilling method.

The difficulty for solving the above problems and defects is as follows.

It is difficult to control the process of gas hydrate decomposition induced by depressurization or heating. If the decomposition speed is too high, a large amount of fluid can be released to affect the shear strength of sediments, so that disasters such as submarine slides, damages to submarine engineering and the like can be caused. In addition, the current research on submarine methane leakage mostly describes its characteristics, scope, flux and control factors, but what human being can do for the submarine methane leakage has not been studied yet.

The significance of solving the above problems and defects is as follows. The disclosure provides a brand-new gas hydrate production method for establishing a submarine gas hydrate production house for the first time, and discloses a novel deep-sea submarine gas hydrate collecting method, which is inspired by a land greenhouse, combines the characteristics of a large amount of submarine methane leakage at the LLGHSZ of the sea area and the characteristics that the water body near the LLGHSZ also belongs to the gas hydrate stability zone and the like. The method is very innovative, and it is a powerful supplement to the traditional hydrocarbon energy exploitation method if the method can be popularized and implemented in the global sea area in the future, and has epoch-making significance. According to the method, a large amount of methane leaked from the seabed at the LLGHSZ not only can be collected in the form of gas hydrate, but also more importantly, the methane leaked from the seabed can be prevented from entering the seawater and even the atmosphere so as to avoid serious climate impact. Therefore, the method has dual meanings of resource acquisition and environmental protection.

SUMMARY

For the problems in the prior art, the disclosure provides a deep-sea submarine gas hydrate collecting method and a production house.

The disclosure is achieved by a deep-sea submarine gas hydrate collecting method, and the deep-sea submarine gas hydrate collecting method, comprises the following steps:

step 1: determining an active methane leakage zone near a deep-sea submarine LLGHSZ strip, determining a seabed methane leakage rate near the LLGHZ strip according to seabed methane leakage in-situ observation data acquired by using ROV and other equipment, and evaluating the economy;

step 2: taking the active methane leakage zone near the LLGHSZ strip selected by S101 as a working area, mounting a fixed underframe and a lifting column on the seabed, adjusting the height of the lifting column according to the seabed topography (slope gradient, lithology and the like) to keep the top of the lifting column horizontal so as to mount a ceiling, a side wall and so on at a later stage; monitoring the methane leakage condition and hydrate generation condition in the house by mounting a deep-sea underwater camera on the fixed underframe;

step 3: mounting a side wall of the ceiling in a clamping groove at the top of the lifting column, with the function of preventing methane from escaping; mounting the detachable ceiling on a buckle switch at the top of the lifting column, and closing the switch;

step 4: after all ceiling units are mounted, a support frame is inserted into a lifting ring, with one function to maintain the integral stability of the house, and the other function to connect all the ceiling units when the ceiling moves integrally; and two side walls are arranged on two sides of the house to prevent methane from escaping;

step 5: after the house is mounted, opening a hydrate generation monitoring system, monitoring the submarine methane leakage condition and hydrate generation progress in real time, and evaluating a hydrate generation amount;

step 6: collecting the hydrate when the hydrate is generated to a certain volume; firstly, lowering a hoist rope from an offshore platform, and connecting the hoist rope with the lifting ring; and then opening the buckle switch at the top of the lifting column, and lifting the ceiling to the offshore platform;

step 7: rapidly processing the gas hydrate in the house by utilizing a gas hydrate collecting system of the offshore platform; and continuously monitoring the methane leakage condition, and if its leakage flux is large, continuously lowering another group of ceilings for deep-sea gas hydrate production, and repeating the steps above Further, in step 1, seabed methane leakage in-situ observation data comprises rate, bubble size, leakage zone and other parameters. The in-situ observation data are generally obtained by means of a side-scan sonar system, a multi-beam echo detection system, a seismic reflection detection system, and fine detection near the seabed by means of acoustic equipment carried by a remote-controlled submersible.

Further, in step 1, the amount of leaked methane per year=methane leakage rate (mol/yr/km)×methane leakage strip length (km)×methane molar mass (16 g/mol)×methane concentration value (0.0014 $m^3/g$).

Further, in step 2, the lifting column has a maximum telescopic height set to be 10 m.

Further, in step 3, the ceiling consists of a ceiling unit, a connection structure between the ceiling units and a mesh partition.

Further, in step 5, the specific process for evaluating the hydrate generation amount includes estimating the volume of the hydrate and the volume of contained methane gas according to the measured average thickness of a hydrate layer and the length and width of the house ceiling.

The disclosure further aims to provide a deep-sea submarine gas hydrate production house for implementing the deep-sea submarine gas hydrate collecting method, wherein the deep-sea submarine gas hydrate production house is provided with a fixed underframe, the fixed underframe is inserted into seabed sediments, and a deep-sea underwater camera is fixed on the fixed underframe; a lifting column is fixed on an upper side of the fixed underframe, and a lifting column clamping groove is provided in the lifting column; and the lifting column clamping groove is clamped with a first side wall, and the top end of the lifting column is provided with a buckle switch and a lifting ring;

the top end of the lifting column is fixed with a detachable ceiling, ceiling connection structures are arranged between the detachable ceiling units, and the detachable ceiling is provided with a ceiling unit and a mesh partition; and a second side wall is fixed on a front side and a rear side of the detachable ceiling;

a top wall, the side wall and the mesh partition of the hydrate production house are made of semi-hard plastic, such as PE, PVC and the like;

an offshore platform is arranged on the sea surface at the upper part of the hydrate production house, and a gas hydrate collecting system is arranged on the offshore platform; and a horizontal arm support is fixed on an upper side of the offshore platform, and hoist ropes are fixed on two sides of the horizontal arm support.

Further, the first side wall is parallel to the trend direction of the slope, and the second side wall is perpendicular to the trend direction of the slope.

Furthermore, the lifting ring is mounted at the top of the lifting column, and an lifting hole of the lifting ring is designed to be in a horizontal direction for conveniently mounting a support frame.

Further, the ceiling connection structure mounts different numbers of ceiling units together in different working areas, each unit having a detachable ceiling, a first side wall, and a mesh partition.

Further, the offshore platform is a transportable floating mobile platform, a truss structure raised above the sea surface and having a horizontal table.

By combining all the technical solutions, the disclosure has the following advantages and positive effects.

The disclosure provides a novel deep-sea submarine gas hydrate collecting method, namely a method for establishing a submarine gas hydrate production house. The method is proposed for the first time at home and abroad. It is a brand-new energy development mode, a powerful supplement to the existing hydrate exploitation mode, and has strong innovation. The disclosure is inspired by the greenhouse on land, the concept of the greenhouse is firstly applied to energy development, and the greenhouse technology is combined with the LLGHZ characteristics. The greenhouse technology is upgraded and reformed, so that the greenhouse technology is applied to collection of leaked methane at the LLGHSZ. The method has low cost, and operating environment above the seabed, which is not easy to cause disasters such as seabed slides and the like, and it has high operability. Firstly, an active methane leakage strip is determined at a submarine LLGHSZ of a working area, and the economy of establishing a submarine hydrate production house is evaluated according to a submarine methane leakage flux monitored by a submarine observation system; when the evaluation result is feasible, a fixed underframe and a lifting column are mounted according to the topography of the submarine methane leakage strip, and the height of the bottom of the lifting column can be freely adjusted, so that the ceiling of the hydrate collecting device of the house body is not affected by the topography; in addition, the body part for the house mounting includes a detachable ceiling, a side wall, a mesh partition for preventing the hydrate from falling off and the like; after the mounting, a production period starts in which leaked methane is combined with water to form gas hydrate; when the leaked methane generates a certain amount of gas hydrate on a top wall of the house, or the methane has a weakened leakage strength or even enters a dormancy period, and the hydrate generation rate is reduced to a certain degree, a top switch of the lifting column of the house is opened, and the body of the house is pulled to an operation platform on the sea surface to perform the hydrate collection work. According to the method provided by the disclosure, on one hand, a large amount of methane leaked from the seabed at the LLGHSZ can be collected in a form of generating gas hydrate by a pollution-free collection system; and on the other hand, the methane leaked from the seabed can be prevented from entering the sea water and even the atmosphere to cause serious environmental and climatic influences. Therefore, the method has dual meanings of resource acquisition and environmental protection. If the method can be popularized in the sea area around the world, a new direction of hydrocarbon energy exploitation can be developed, which has great significance.

DETAILED DESCRIPTION OF THE EMBODIMENTS

In order that the objects, technical solutions, and advantages of the disclosure will become more apparent, the disclosure will be described in further detail with reference to embodiments. It should be understood that the specific embodiments described herein are merely illustrative of the disclosure and are not intended to be limiting thereof.

For the problems in the prior art, the disclosure provides a deep-sea submarine gas hydrate collecting method and a production house, and the disclosure is described in detail with reference to the drawings.

Figure 1:
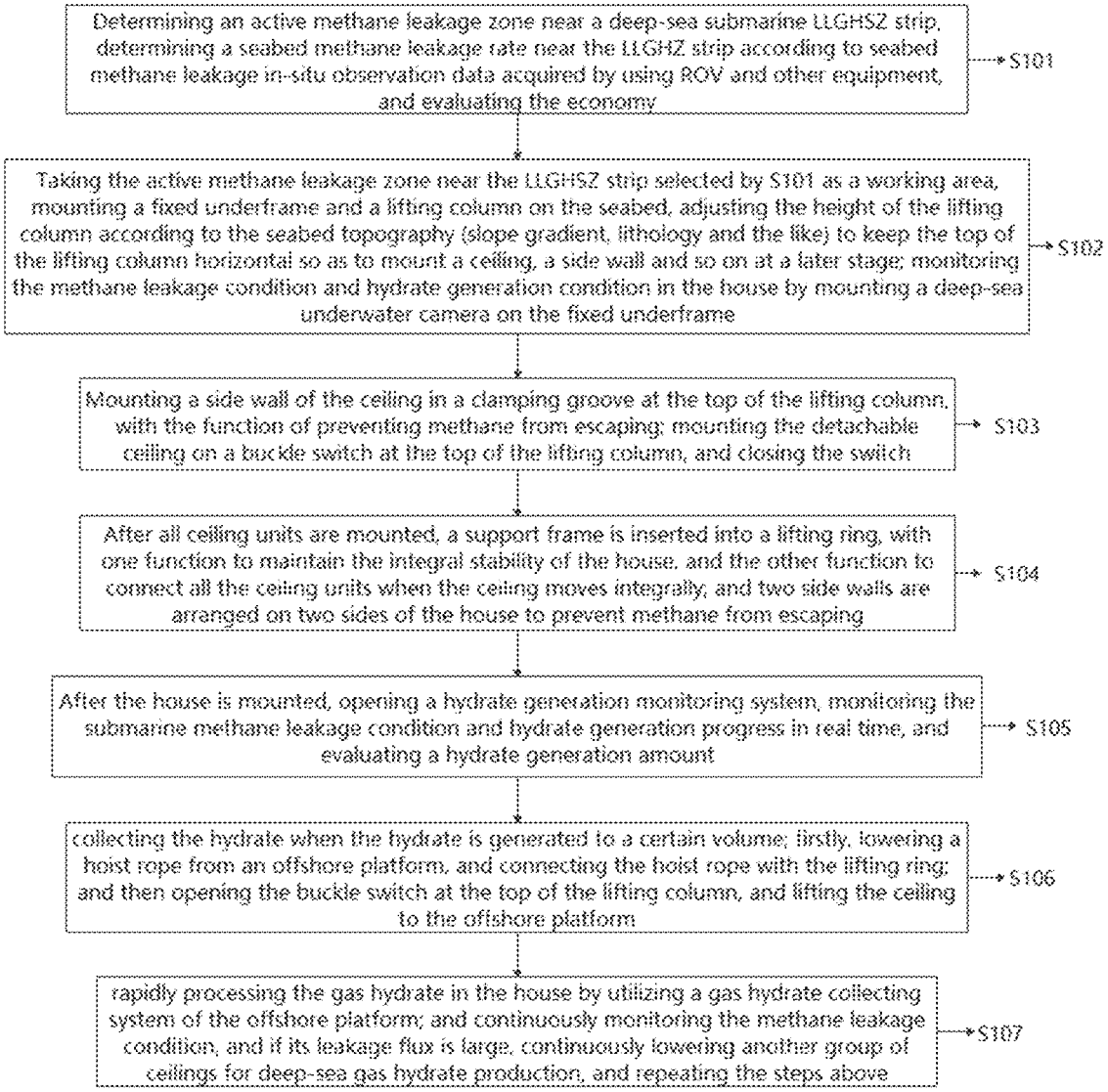
FIG. 1 is a flow chart of a deep-sea submarine gas hydrate collecting method according to an embodiment of the disclosure.

As shown in FIG. 1, it is the deep-sea submarine gas hydrate collecting method provided by an embodiment of the disclosure, comprising the following steps:

S101: determining an active methane leakage zone near a deep-sea submarine LLGHSZ strip, determining a seabed methane leakage rate near the LLGHZ strip according to seabed methane leakage in-situ observation data acquired by using ROV and other equipment, and evaluating the economy;

S102: taking the active methane leakage zone near the LLGHSZ strip selected by S101 as a working area, mounting a fixed underframe and a lifting column on the seabed, adjusting the height of the lifting column according to the seabed topography (slope gradient, lithology and the like) to keep the top of the lifting column horizontal so as to mount a ceiling, a side wall and so on at a later stage; monitoring the methane leakage condition and hydrate generation condition in the house by mounting a deep-sea underwater camera on the fixed underframe;

S103: mounting a side wall of the ceiling in a clamping groove at the top of the lifting column, with the function of preventing methane from escaping; mounting the detachable ceiling on a buckle switch at the top of the lifting column, and closing the switch;

S104: after all ceiling units are mounted, a support frame is inserted into a lifting ring, with one function to maintain the integral stability of the house, and the other function to connect all the ceiling units when the ceiling moves integrally; and two side walls are arranged on two sides of the house to prevent methane from escaping;

S105: after the house is mounted, opening a hydrate generation monitoring system, monitoring the submarine methane leakage condition and hydrate generation progress in real time, and evaluating a hydrate generation amount;

S106: collecting the hydrate when the hydrate is generated to a certain volume; firstly, lowering a hoist rope from an offshore platform, and connecting the hoist rope with the lifting ring; and then opening the buckle switch at the top of the lifting column, and lifting the ceiling to the offshore platform;

S107: rapidly processing the gas hydrate in the house by utilizing a gas hydrate collecting system of the offshore platform; and continuously monitoring the methane leakage condition, and if its leakage flux is large, continuously lowering another group of ceilings for deep-sea gas hydrate production, and repeating the steps above According to S101 provided by the embodiment of the disclosure, seabed methane leakage in-situ observation data comprises methane leakage rate, bubble size, leakage zone and other parameters.

In S102 provided by the embodiment of the disclosure, the lifting column has a maximum telescopic height set to be 10 m.

According to S103 provided by the embodiment of the disclosure, a ceiling consists of a ceiling unit, a connection structure between the ceiling units and a mesh partition. The mesh partition serves to prevent the hydrate from falling off during generation and collection.

According to S105 provided by the embodiment of the disclosure, the specific process for evaluating the hydrate generation amount includes estimating the volume of the hydrate and the volume of contained methane gas according to the measured average thickness of a hydrate layer.

Figure 2:
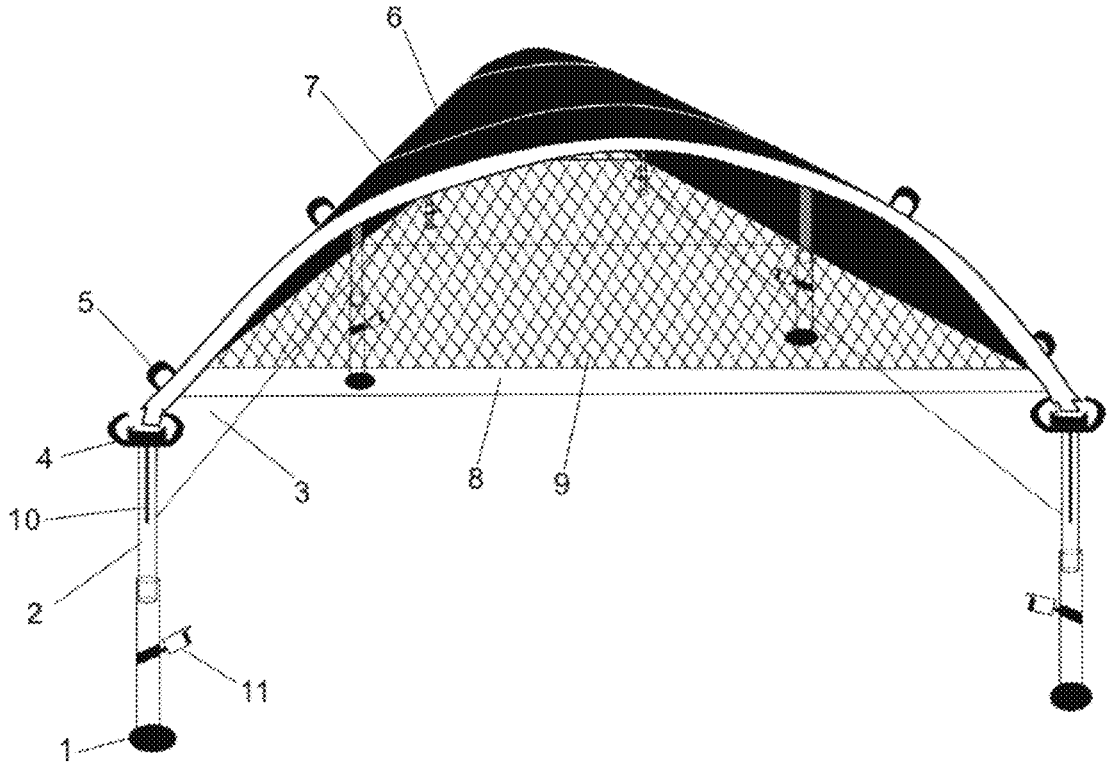
FIG. 2 is a schematic side view of a deep-sea submarine gas hydrate production house structure according to an embodiment of the disclosure.
Figure 3:
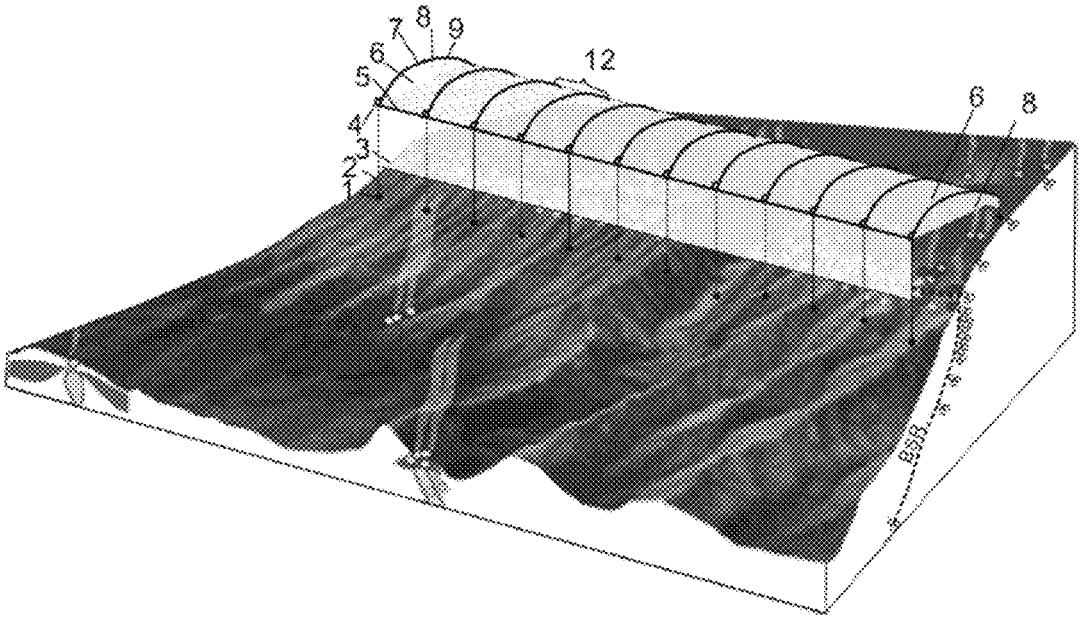
FIG. 3 is a three-dimensional schematic diagram of a deep-sea submarine gas hydrate production house structure according to an embodiment of the disclosure.
Figure 4:
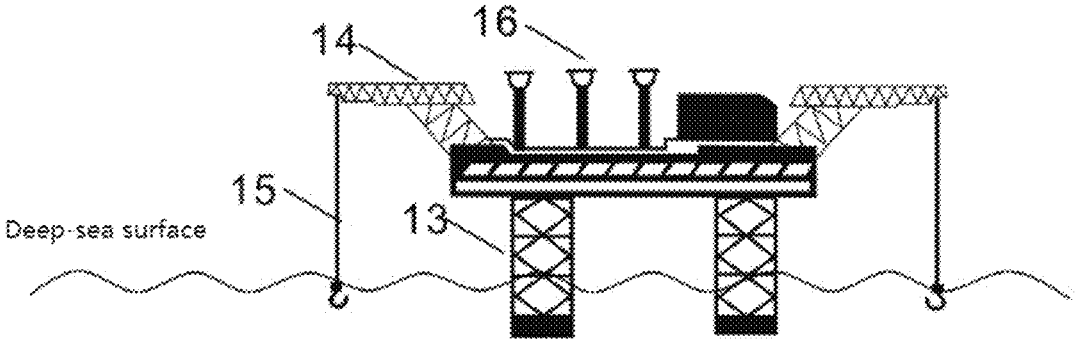
FIG. 4 is a schematic view showing the structure of an offshore platform, a horizontal arm support and a hoist rope according to an embodiment of the disclosure.
Figure 5:
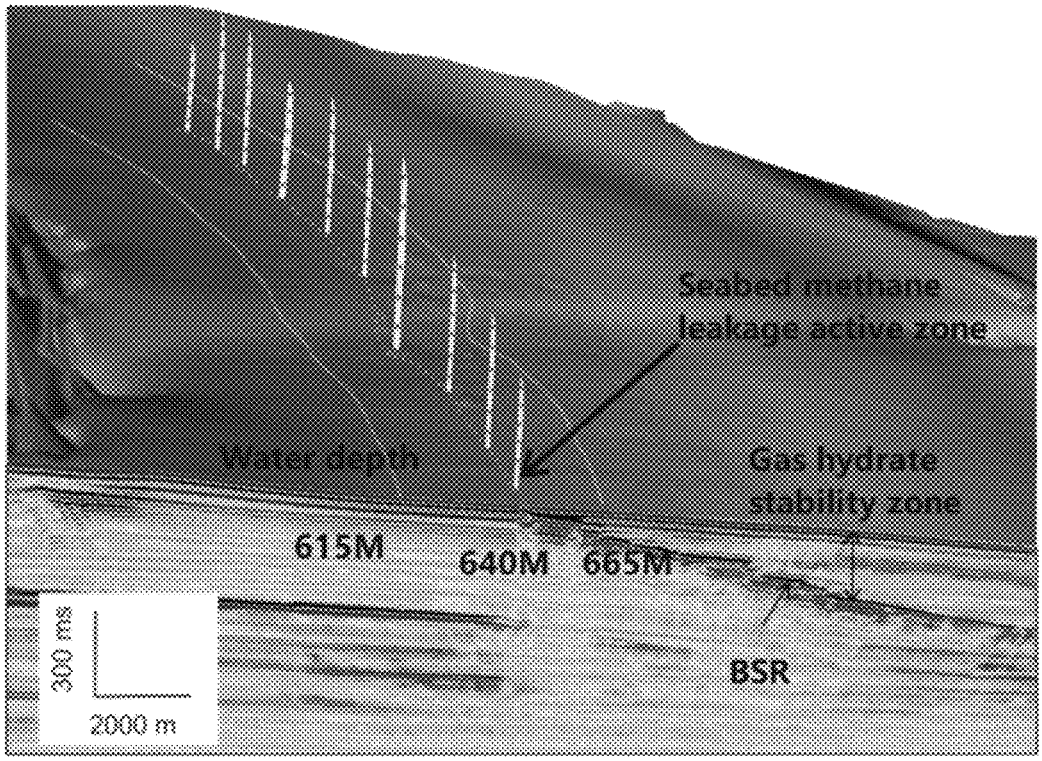
FIG. 5 is a schematic diagram of a submarine methane leakage zone 1 (West African region) associated with LLGHSZ according to an embodiment of the disclosure.
Figure 6:
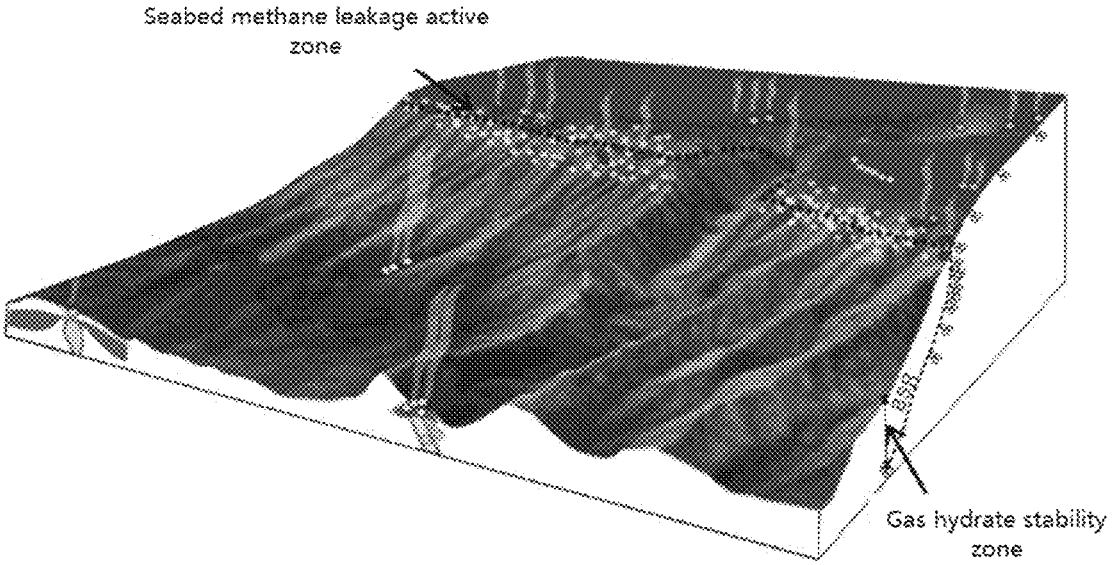
FIG. 6 is a schematic diagram of a submarine methane leakage zone 2 (Atlantic continental margin) associated with the LLGHSZ according to an embodiment of the disclosure.
Figure 7:
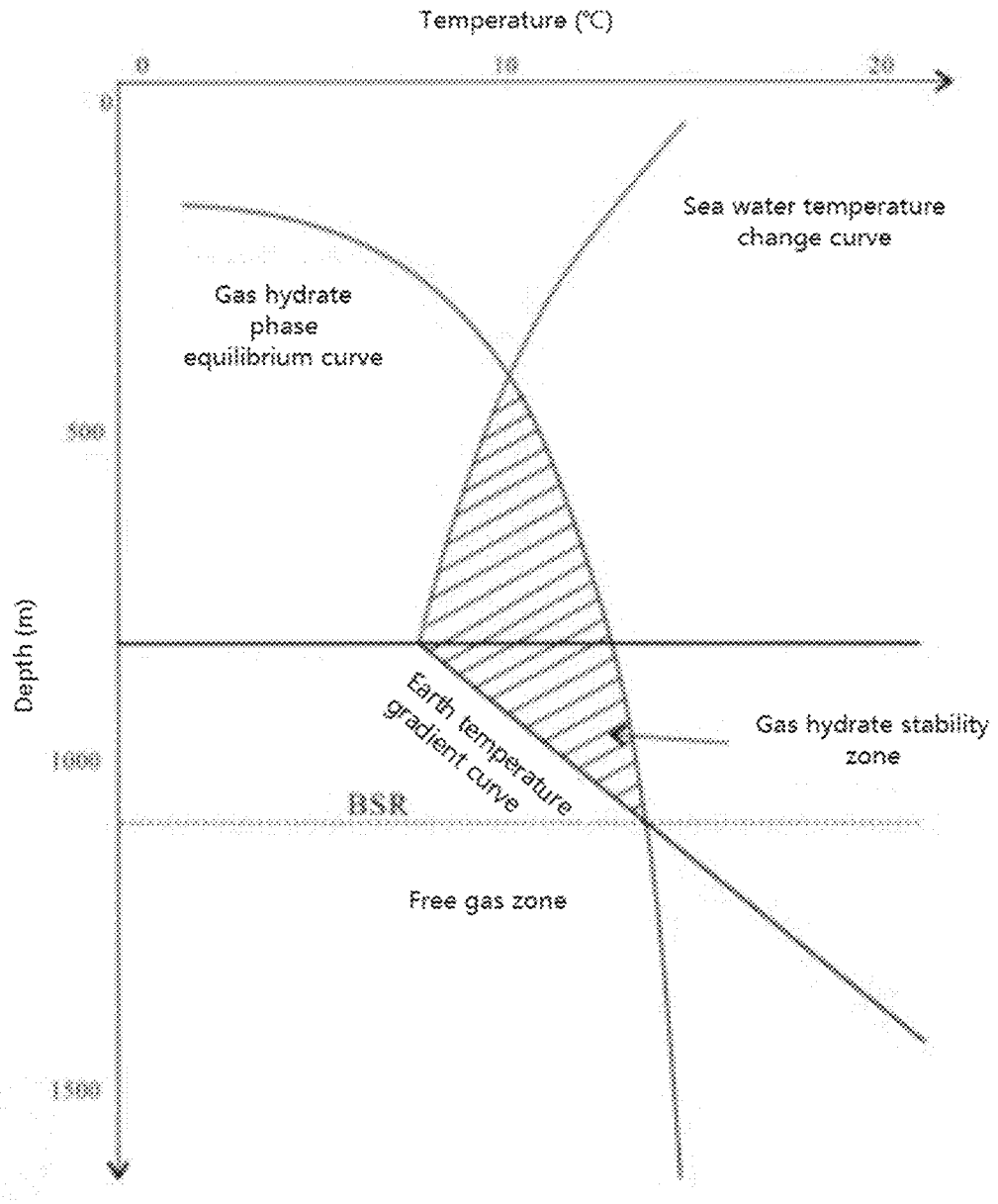
FIG. 7 is a schematic diagram of stable phase equilibrium of gas hydrates at the sea area according to an embodiment of the disclosure.

When the hydrate generation thickness is about 0.5 m, the volume of the hydrate is about 0.5 m (length)×50 km (width)×10 m (height)=$2.5\times10^5$ $m^3$, which is equivalent to $41\times10^6$ $m^3$ methane gas;

As shown in FIGS. 2-4, in an deep-sea submarine gas hydrate production house provided by the embodiment of the disclosure, the fixed underframe 1 is inserted into seabed sediments, and a deep-sea underwater camera 11 is fixed on the fixed underframe 1; a lifting column 2 is fixed on an upper side of the fixed underframe 1, and a lifting column clamping groove 10 is provided in the lifting column 2; the lifting column clamping groove 10 is clamped with a first side wall 3, and the top end of the lifting column 2 is provided with a buckle switch 4 and a lifting ring 5.

A detachable ceiling 6 is fixed on a first side wall 3, a ceiling connection structure 7 is fixed on an upper side of the detachable ceiling 6, and the detachable ceiling 6 is provided with a ceiling unit 12 and a mesh partition 9; and a second side wall 8 is fixed on a front side and a rear side of the detachable ceiling 6.

An offshore platform 13 is arranged on the upper side of the detachable ceiling 6, and a gas hydrate collecting system 16 is arranged on the upper side of the offshore platform 13; and a horizontal arm support 14 is fixed on an upper side of the offshore platform 13, and hoist ropes 15 are fixed on two sides of the horizontal arm support 14.

The technical solution of the disclosure is further described below with reference to embodiments.

The disclosure provides a novel deep-sea submarine gas hydrate collecting method, namely a method for establishing a submarine gas hydrate production house. The method is inspired by the greenhouse on land, and a gas hydrate production house on the deep sea bed is established according to a large amount of methane flux released at the LLGHSZ and the characteristic that water body at an upper part of the LLGHSZ belongs to a gas hydrate stability zone. Firstly, an active methane leakage strip is determined at a submarine LLGHSZ of a working area, and the economy of establishing a submarine hydrate production house is evaluated according to a submarine methane leakage flux monitored by a submarine observation system; when the evaluation result is feasible, a fixed underframe and a lifting column are mounted according to the topography of the submarine methane leakage strip, and the height of the bottom of the lifting column can be freely adjusted, so that the hydrate collecting device of the house body is not affected by the topography; in addition, the body part for the house mounting includes a detachable ceiling, a side wall, a mesh partition for preventing the hydrate from falling off and the like; after the mounting, a production period starts in which leaked methane is combined with water to form gas hydrate; when the leaked methane generates sufficient gas hydrate on a top wall of the house, or the methane has a weakened leakage strength or even enters a dormancy period, and the hydrate generation rate is reduced to a certain degree, a top switch of the lifting column of the house is opened, and the body of the house is pulled to an operation platform on the sea surface by the horizontal arm support and the hoist rope of the offshore platform; finally, the gas hydrate collection work is performed the offshore platform, thereby achieving the purpose of pollution-free collection of methane leakage at the LLGHSZ. The specific structure of the deep-sea submarine gas hydrate production house is shown in a three-dimensional view (FIG. 3) of the gas hydrate production house and a side view (FIG. 2) of the house, and the structures are illustrated as follows.

The fixed underframe 1 plays a role of fixing and supporting after being inserted into the seabed sediments; in addition, the deep-sea underwater camera 11 is mounted on the fixed underframe and can be used in the underwater pressure environment within 10000 meters, with compressive strength reaching 100 MPa.

The lifting column 2 has a maximum telescopic height set to be 10 m, the height can be adjusted according to the topography, and the ceiling of the house can be kept horizontal in a region with a steep slope; an upper part of the lifting column is provided with a 1 m clamping groove which is used for mounting the side wall of the house; an top end of the lifting column is provided with a buckle switch for clamping and fixing the detachable ceiling; and after a certain amount of hydrate is generated or when leaked methane is dormant, the switch can be opened, and the ceiling is lifted to a platform on the sea surface for hydrate collection.

The first side wall 3 is parallel to the trend direction of the slope, so that the leaked methane gas is prevented from laterally escaping, the gas hydrate is guaranteed to be generated in the house, and the lifting columns are connected at the same time, achieving the fixing effect and improving the stability of the house.

The lifting rings 5 is mounted at the bottom of the two sides of the ceiling, and the hoist ropes of the offshore platform are hung on the lifting rings for operation, so that the detachable ceiling can be lowered from the offshore platform to the seabed, or the detachable ceiling at the seabed can be lifted to the offshore platform; a lifting hole of the lifting ring is designed to be in a horizontal direction for a lifting function, and in addition to this, the support frame can be inserted into the lifting ring.

The support frame is inserted into the lifting ring 4 after the ceiling is mounted, with one function to maintain the integral stability of the house, and the other function to connect all ceiling units when the ceiling moves integrally.

The detachable ceiling 6, i.e. the top of the house, is a main collection device for leaked methane gas, where methane combines with water to form gas hydrate.

The ceiling connection structure 7 can be used for mounting different numbers of ceiling units together in different working areas, each unit having a detachable ceiling 6, a first side wall 3 and a mesh partition 9.

The second side wall 8 is perpendicular to the trend direction of the slope and prevents methane gas from escaping laterally.

The mesh partition 9 is located at the bottom of the ceiling and can prevent the generated gas hydrate from falling off while ensuring the free entry of methane gas.

The ceiling unit 12 includes a first side wall 3, a lifting ring 5, a detachable ceiling 6, a ceiling connection structure 7 and a mesh partition 9; it can be assembled and disassembled repeatedly, different numbers of ceiling units can be mounted together in different working areas according to the methane leakage zone so as to form a deep-sea gas hydrate production house suitable for a specific submarine methane leakage zone.

The offshore platform 13 is a transportable floating mobile platform, a truss structure raised above the sea surface and having a horizontal table; the gas hydrate house on the deep sea bed is constructed along the LLGHSZ strip which runs parallel to the land slope, with the length reaching dozens of kilometers or even hundreds of kilometers; the movable platform can perform daily offshore operation activities such as gas hydrate house construction, maintenance, hydrate collection and the like at places frequently replaced along the LLGHSZ strip.

The horizontal arm support 14 is configured for adjusting the position in the horizontal direction to enable the hoist rope to reach the working position.

The hoist rope 15 is configured for conveying the structures of the house to the seabed or lifting the same to the sea surface.

The gas hydrate collecting system 16 collects the gas hydrate generated on the ceiling wall of the house.

The size of the deep-sea gas hydrate house is not fixed and can be designed according to the length and the width of the submarine methane leakage characteristic of a specific working area; it is not only suitable for seabed methane leakage at the LLGHSZ, but also can be applied to methane leakage points/lines at intersections of deep fractures, diapir structures and the like with the seabed; the velocity and flux of methane leakage are not constant, but vary with time, season and so on; and when the methane leakage point of the seabed is dormant and methane is no longer leaked, the operation can be stopped, and the collection is carried out again when the methane leakage point is monitored to be restored.

If the methane leakage velocity is about $5.4\times10^6$ mol/yr/km in the deep-sea LLGHSZ of the Cascadia continental margin, the methane molar mass is 16 g/mol and the concentration is 0.0014 $m^3$/g under the reference standard condition, the methane leakage is $6.05\times10^6$ $m^3$ per year near the 50 km long LLGHSZ strip; for example, in areas where the methane leakage is more active, such as Coal Oil Point, the methane leakage velocity can reach 1825 $(\pm274)\times10^9$ mol/yr at a certain submarine methane leakage point; and if a hydrate house is constructed here, the methane leaked every year has the amount of $4.088\times10^{10}$ $m^3$, which has a larger production scale.

The method disclosed by the disclosure includes constructing the hydrate house on the deep sea bed instead of deep-sea drilling operation, so that the cost is far lower than that of a conventional oil gas production method; in addition, the gas hydrate has a very high energy density, $6.05\times10^6$ $m^3$ methane (the amount of methane leaked per year in the deep-sea LLGHSZ of the Cascadia continental margin extending for 50 km); and if all the gas hydrate is generated in a volume of about 36890 $m^3$, assuming a house width of about 10 m, the hydrate generated has a thickness of about 0.074 m and is very thin. Therefore, although the methane leakage of the seabed is large, the hydrate is extremely high in energy density, and large-volume hydrate cannot be rapidly generated on the top of the house, so that the ceiling does not need to be frequently lifted to the offshore platform for hydrate collection after the house is mounted.

At present, practical operation has not been carried out at home and abroad, but the data such as the methane leakage rate provided by the disclosure have great significance for analyzing the methane leakage amount of the seabed.

In the description of the disclosure, unless otherwise indicated, the meaning of "a plurality" means two or more; the terms "upper", "lower", "left", "right", "inner", "outer", "front", "rear", "head", "tail", and the like, which refer to orientation or position relationships are based on the orientation or position relationships shown in the drawings and are merely intended to facilitate describing the disclosure and to simplify the description. The terms are not intended to indicate or imply that the referred device or element must have a particular orientation, and be constructed and operated in a particular orientation, which thus should not be construed as limiting the disclosure. Furthermore, the terms "first", "second", "third", and the like are used for descriptive purposes only and are not to be construed as indicating or implying relative importance.

The above are only specific embodiments of the present disclosure, but the protection scope of the present disclosure is not limited thereto. A person skilled in the art makes any modification, equivalent replacement and improvement according to the spirit and principle of the present disclosure within the technical scope disclosed in the present disclosure should be covered by the protection scope of the present disclosure.

What is claimed is:

1. A deep-sea submarine gas hydrate collecting method, comprising steps of:

determining a submarine methane leakage rate near an LLGHZ strip according to submarine methane leakage in-situ observation data;

taking an active methane leakage zone near selected deep-sea submarine LLGHSZ strip as a working area, and adjusting a height of a mounted lifting column according to submarine topography; and monitoring methane leakage condition and hydrate generation condition in a house by using a mounted deep-sea underwater camera;

mounting a side wall of a ceiling in a clamping groove at a top of the mounted lifting column, and mounting the detachable ceiling on a buckle switch at the top of the mounted lifting column;

inserting a lifting ring into a support frame, connecting a plurality of ceiling units, and mounting two side walls on two sides of the house;

opening a hydrate generation monitoring system, monitoring submarine methane leakage condition and hydrate generation progress in real time, and evaluating a hydrate generation amount;

collecting a hydrate when the hydrate is generated to a certain volume;

processing a gas hydrate in the house by utilizing a gas hydrate collecting system; and continuously monitoring the submarine methane leakage condition, and if its leakage flux is active, continuously producing the deep-sea gas hydrate.

2. The deep-sea submarine gas hydrate collecting method according to claim 1, wherein submarine methane leakage in-situ observation data comprises parameters of methane leakage rate, bubble size and leakage zone.

3. The deep-sea submarine gas hydrate collecting method according to claim 1, wherein the mounted lifting column has a maximum telescopic height of 10 meters.

4. The deep-sea submarine gas hydrate collecting method according to claim 1, wherein the ceiling consists of the ceiling units, a connection structure between the ceiling units and a mesh partition.

5. The deep-sea submarine gas hydrate collecting method according to claim 1, wherein a specific method for evaluating the hydrate generation amount includes estimating a volume of the hydrate and the volume of contained methane gas according to the measured average thickness of a hydrate layer.

6. A deep-sea submarine gas hydrate production house for implementing the deep-sea submarine gas hydrate collecting method according to claim 1, wherein the deep-sea submarine gas hydrate production house is provided with:

a fixed underframe;

wherein the fixed underframe is inserted into seabed sediments, and a deep-sea underwater camera is fixed on the fixed underframe; a lifting column is fixed on an upper side of the fixed underframe, and a lifting column clamping groove is provided in the lifting column; and the lifting column clamping groove is clamped with a first side wall, and a top end of the lifting column is provided with a buckle switch and a lifting ring;

the top end of the lifting column is fixed with a detachable ceiling by the buckle switch, ceiling connection structures are arranged between a plurality of detachable ceiling units, and the detachable ceiling is provided with the ceiling units and a mesh partition; and a second side wall is fixed on a front side and a rear side of the detachable ceiling;

a top wall, a side wall and the mesh partition of a hydrate production house are made of semi-hard plastic including PE and PVC materials;

an offshore platform is arranged on sea surface at a upper part of the hydrate production house, and a gas hydrate collecting system is arranged on the offshore platform; and a horizontal arm support is fixed on an upper side of the offshore platform, and hoist ropes are fixed on two sides of the horizontal arm support.

7. The deep-sea submarine gas hydrate production house according to claim 6, wherein the first side wall is parallel to a trend direction of a slope, and the second side wall is perpendicular to the trend direction of the slope.

8. The deep-sea submarine gas hydrate production house according to claim 6, wherein the lifting ring is mounted at a top end of the lifting column, and a lifting hole of the lifting ring is in a horizontal direction for conveniently mounting a support frame.

9. The deep-sea submarine gas hydrate production house according to claim 6, wherein ceiling connection structure mounts different numbers of ceiling units together in different working areas, each unit having the detachable ceiling, the first side wall, and the mesh partition.

10. The deep-sea submarine gas hydrate production house according to claim 6, wherein the offshore platform is a transportable floating mobile platform.

* * * * *